United States Patent [19]

Schindele et al.

[11] Patent Number: 4,541,254

[45] Date of Patent: Sep. 17, 1985

[54] NEEDLE SELECTOR DEVICE FOR MULTI-SYSTEM KNITTING MACHINE

[75] Inventors: Alfred Schindele, Filderstadt; Herbert Lotze, Stuttgart, both of Fed. Rep. of Germany

[73] Assignee: Terrot Strickmaschinen GmbH, Stuttgart, Fed. Rep. of Germany

[21] Appl. No.: 501,885

[22] Filed: Jun. 7, 1983

[30] Foreign Application Priority Data

Jun. 18, 1982 [DE] Fed. Rep. of Germany ..... 3222744

[51] Int. Cl.[3] ..... D04B 15/68; D04B 15/76

[52] U.S. Cl. ..... 66/223; 66/228; 66/238

[58] Field of Search ..... 66/42 R, 75.1, 223, 66/224, 226, 227, 228, 238

[56] References Cited

U.S. PATENT DOCUMENTS

| | | | |
|---|---|---|---|
| 2,199,636 | 5/1940 | Lawson | 66/238 |
| 2,240,421 | 4/1941 | Shelmire | 66/228 X |
| 3,391,549 | 7/1968 | Fontaine | 66/224 X |
| 3,763,667 | 10/1973 | Mishcon | 66/223 |
| 3,789,629 | 2/1974 | Carrotte et al. | 66/223 |

FOREIGN PATENT DOCUMENTS

| | | | |
|---|---|---|---|
| 2159538 | 6/1973 | Fed. Rep. of Germany | 66/224 |
| 2320793 | 11/1974 | Fed. Rep. of Germany | 66/226 |
| 3023077 | 1/1981 | Fed. Rep. of Germany | 66/228 |
| 437992 | 11/1935 | United Kingdom . | |
| 575702 | 3/1946 | United Kingdom | 66/224 |
| 709209 | 5/1954 | United Kingdom . | |
| 996291 | 6/1965 | United Kingdom | 66/224 |
| 1014640 | 12/1965 | United Kingdom . | |
| 1022401 | 3/1966 | United Kingdom . | |
| 1111742 | 5/1968 | United Kingdom . | |
| 1212574 | 11/1970 | United Kingdom | 66/224 |
| 1251646 | 10/1971 | United Kingdom . | |
| 1404811 | 9/1975 | United Kingdom . | |
| 558986 | 7/1977 | U.S.S.R. | 66/226 |
| 658193 | 4/1979 | U.S.S.R. | 66/226 |

*Primary Examiner*—Wm. Carter Reynolds

*Attorney, Agent, or Firm*—Bernard, Rothwell & Brown

[57] ABSTRACT

A needle selector device for a multi yarn feed knitting machine comprises a stack of angularly movable sliders mounted about a common axis, the sliders being selectively movable between three positions, namely the knitting, tucking and floating positions. The sliders define cams which depending on the selected position of the slider can engage steering butts on a pivotable pattern bar connected through a swivel bar to a knitting needle.

6 Claims, 16 Drawing Figures

NEEDLE SELECTOR DEVICE FOR MULTI-SYSTEM KNITTING MACHINE

This invention relates to a needle-selector device for use in a multi yarn feeding station knitting machine operating by the three-way method, with vertically stacked sliders, with pattern bars comprising steering butts and with swivel bars supported on the pattern bars and in their turn articulately connected to the knitting needles, the sliders co-acting with the steering butts of the pattern bars and thereby selectively steering the knitting needles into their floating, tucking or knitting position.

In known selector devices of this kind there are provided for each station in the machine, two rows of vertically stacked sliders, or even double sliders, which are expensive to construct and which also require a large amount of space. Owing to the considerable amount of space required the known devices either cannot be accommodated in machines with numerous stations, in which the individual stations are comparatively narrow, or else the number of stations in a machine of predetermined dimensions cannot be increased if a selector device of the kind described is used.

It is the aim of the present invention to propose a device of the kind specified which is simple and uncomplicated and therefore can be produced at an economical cost whilst functioning in a reliable and secure manner, which takes up very little space on a knitting machine so that it can be applied particularly to knitting machines with large numbers of stations.

The aim of the invention is realised due to the fact that for each station of the knitting machine one single row of superposed sliders is provided which are rotatable about a common axis and adapted to be selectively adjusted into operative positions corresponding to the floating, tucking or knitting positions respectively and to be locked in such position.

The invention is hereinafter more particularly explained with reference to the accompanying drawings in which:

FIG. 1 schematically shows the arrangement of one knitting needle with the associated pattern bar in a knitting machine which operates by the three-way-technique, or Jacquard method, with associated needle selector device;

FIG. 2 schematically shows a lock-groove or trick;

FIGS. 3 to 5 schematically illustrate a rotary slider which is designed as a selector lever, in three different working positions thereof;

Figure 1:
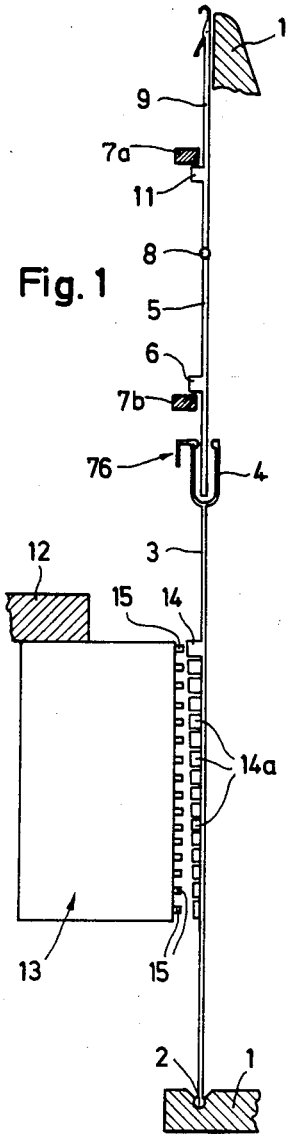

With reference to FIG. 1 there is shown a pattern bar 3 of conventional design having a forked head 4. The bar 3 is pivotally supported at 2 in the revolving needle cylinder 1 of a multi station circular knitting machine. A swivel bar 5 with a butt 6 is supported in the head 4. The butt 6 is guided in conventional manner in a groove or trick formed by a lock parts 7*a* and 7*b* fixed to the structure of the machine. The upper end of the swivel bar 5 is connected through an articulated joint 8 to a knitting needle 9 the butt 11 of which is also guided in conventional manner by a groove or track of each of the lock parts 7*a* and 7*b*. Swivel bar 5, needle 9 and pattern bar 3, are mounted and guided in the needle cylinder 1. The lower lock part 7*b* which co-acts with butt 6 of swivel bar 5 serves in known manner to push the needle 9 outwardly or upwardly while the upper lock part 7*a* co-acts with the butt 11 of the needle 9 to retract or lower the needle 9.

The invention is hereinafter described in application to a plain circular knitting machine with several feed stations which operates by the three-way technique. However, the invention is equally suitable for application in flat—as well as in flat-circular knitting machines, and these machines may also be double-knit machines, for example—in the case of a circular knitting machine, they may have an additional rib plate. The circular knitting machines may be small or large machines.

In operation of a circular knitting machine which in its needle cylinder has numerous assemblies of the kind shown in FIG. 1, the knitting needles 9 are moved up and down in conventional manner by the lockguideways, or tricks defined by the stationary lock parts 7*a* and 7*b* while the needle cylinder 1 rotates, and the needles 9 produce a tubular knitted fabric or hose. If a patterned fabric is required the needles must be appropriately selected while the needle cylinder rotates, that is to say during rotation specific needles must be selected and steered in such a way that they will execute no, or only a partial outward movement. This kind of movement of the knitting needles 9 is obtained with the aid of the selector device 13 which is mounted on a fixed part 12 of the machine and schematically illustrated in FIG. 1. Each yarn feed station of the machine has its own selector device 13. The needle selection occurs with the aid of steering butts 14 one of which is provided on each pattern bar 13. The steering butt 14 shown in the top position in FIG. 1 belongs to the illustrated pattern bar 3. The steering butts 14*a* therebeneath belong to other pattern bars arranged behind bar 3, not visible in FIG. 1, which are also pivotally supported in the cylinder 1. The extreme ends 15 of adjustable adjusting members project outwards from the selector device 13. These adjusting members are selectively adjustable in such a way that when the needle cylinder rotates their outer ends 15 come into the trajectory of the respectively associated steering butt 14, or 14*a* of a specific pattern bar 3. These extreme ends 15 are designed in the manner of cams as will be more particularly described below, with cam-faces for engagement with the steering butts 14*a* so that when the butts 14*a* engage with the cams, the pattern bars 3 will be pivoted about the axis of joint 2 in the clockwise direction as shown in FIG. 1 provided that the associated adjusting member, or its extreme end 15, has been correctly adjusted. This also causes pivotal movement of swivel bar 5 the lower end of which is engaged in head 4 of pattern bar 3, about joint 8 so that the butt 6 is pushed out of the effective range of lock part 7*b*. Lock part 7 is thus inoperative and the particular needle 9 which is associated with the swivel bar 5 is no longer moved outwardly. On the other hand, if the extreme end 15 of an adjusting member is, as shown in FIG. 1, retracted so that it does not extend into the trajectory of a steering butt 14*a* the associated pattern bar 3 will remain in the position shown in FIG. 1 and the needle 9 will be driven out by the lock part 7*a* which co-acts with the butt 6 of the associated swivel bar 5. In this manner the device 13 affords the facility of selecting the knitting needles for appropriate movement in accordance with a pattern.

Figure 2:
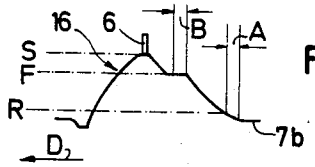

The selector devices according to this invention are used in knitting machines which operate by the three position method. This means that the knitting needles 9 are adapted to be displaced into three different positions, namely into a so-called floating or non-knitting position, a tucking position and a knitting position with a tuck loop being formed in known manner in the tucking position and a knitting stitch in the knitting position. FIG. 2 schematically shows a lock groove or track 16 which is formed in the lower lock part *7b* which steers the butt 6 of the swivel bar 5. The direction of rotation of the needle cylinder 1 is indicated by arrow D. The lock groove 16 viewed in the direction of arrow D from bottom to top comprises three levels R.F.S. corresponding to the floating tucking and knitting positions of needle 9. In FIG. 2 the butt 6 is on level S so that the needle 9 is raised fully and is therefore in the knitting position thereof.

If in region A the butt 6 is pushed away from lock part 7 in the manner described so that the swivel bar 5 and the knitting needle 9 associated therewith cannot be raised further by lock part 7, the needle 9 will remain in its float position R. If butt 6 is pushed off the associated lock part *7b* in region B the needle 9 will remain in the tucking position F. If butt 6 is not pushed away from lock part *7b* the latter will steer the needle 9 into its knitting position S. This is shown in FIG. 2. In this case, therefore, no pivotal movement of pattern bar 3 has been triggered by the selector device 13 whereby, as hereinbefore described, the butt 6 of swivel bar 5 would be disengaged from lock part *7b*. Accordingly the needle 9 is fully raised and comes into the operative knitting position S.

Figure 3:
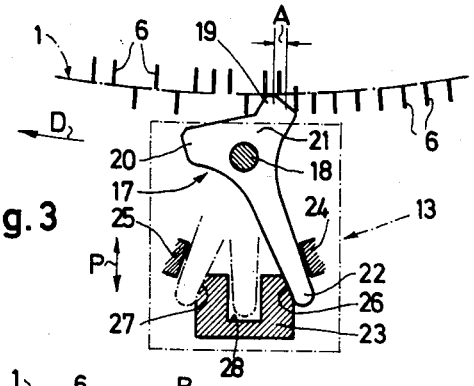

FIG. 3 shows a preferred embodiment of an adjusting member of the selector device 13. The adjusting member is here constructed as an angularly movable slider or selector lever 17. A plurality of such selector levers 17 is arranged in a preferably vertical row one above the other for angular movement about a common axis 18 and their ends which are shaped as cams 19, 20 protrude from the device 13 (see reference 15 in FIG. 1). The selector lever 17 is a two-armed lever. The first lever arm 21 carries the cams 19 and 20 and co-acts with a steering butt 14 of a pattern bar 3. The second lever arm 22 is adapted by means of a common locking block 23 engaging with all of the vertically superposed selector levers 17, to be selectively held against end stop 24 or 25, the said end stops 24, 25 being associated with different working positions of the selector lever 17. The locking block 23 can be slid to and fro in a corresponding guideway in the direction of the double-headed arrow P and can be fixed in its terminal position in any convenient manner for example by screwing, pegging, pinning or clamping. The block has operative engagement faces 26, 27 respectively engaging in the locking positions with lever arm 22 and applying the same firmly to the respective end stop 24 or 25. In the center position of the selector lever 17 the arm 22 thereof is received in reces 28 of the locking block 23. If the locking block 23 is pulled out (downwards as shown in FIG. 3) from the position represented in FIG. 3 in the direction of arrow P, the selector lever 17 can be moved to a different working position in which it can be locked once again by relocating the block 23.

FIG. 3 also shows the butts 6 of the swivel bars 5 which are mounted in the needle cylinder 1. The needle cylinder itself is merely indicated by an arc.

When the selector lever 17 occupies the working position shown in FIG. 3 its cam 19 engages the steering butt 14 of a pattern bar 3 in region A of the lock trick 16 (FIG. 2). Accordingly the pattern bar is pivotally displaced in the time interval corresponding to the lock region A thereby causing the butt 6 of the associated swivel bar 5 to be disengaged relative to lock part *7b*. The swivel bar 5 and associated needle 9 are therefore no longer driven by lock part *7b* and the needle remains in the floating position R.

Figure 4:
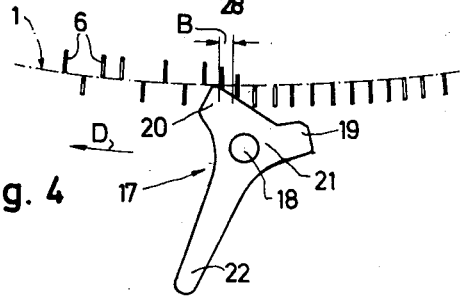

FIG. 4 shows the other extreme position of selector lever 17 in which cam 20 is applied to steering butt 14 of the associated pattern bar 3. Because of the spatial separation of cams 19 and 20 this corresponds to region B of the lock trick 16 (FIG. 2). In this region B needle movement has already taken place over a certain distance. If now in region B the butt 6 of swivel bar 5 is disengaged from lock part *7b* the swivel bar 5 and its needle 9 will remain in the prevailing position, which is the tucking position F.

Figure 5:
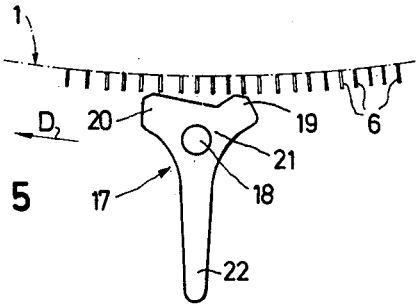

FIG. 5 lastly shows the selector lever 17 in a medial position in which neither cam 19 or cam 20 extend into the trajectory of the steering butts 14*a*. In this case there is no displacement of pattern bar 3 and the associated swivel bar 5 and the butt 6 of swivel bar 5 remains on lock part *7b* and the needle is fully driven out to its knitting position S. Correspondingly FIG. 5 shows the butts 6 of all the swivel bars 5 outside the arc representing the needle cylinder 1 while FIGS. 3 and 4 show the respectively "selected" butts 6 which are then on the inner side of the arc.

The selector levers as described can be built relatively small and since there is only one row of such levers stacked vertically and rotatable about a common axis, the whole assembly takes up very little space so that such selector devices 13 may be used with knitting machines which have very many yarn feed stations.

In order to enable a selector lever 17 to be locked in the medial position corresponding to the knitting position as shown in FIG. 5, the locking block as shown in FIG. 3 has a central recess 28 which engages and locks the second arm 22 of the selector lever 17 in this operative position.

Figure 6:
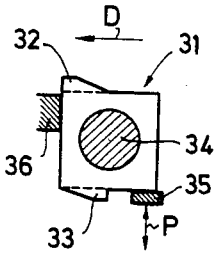
FIGS. 6 to 11 show modified forms of rotary sliders.
Figure 7:
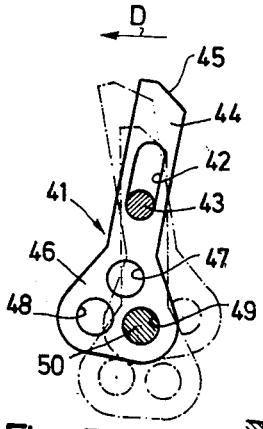
Figure 8:
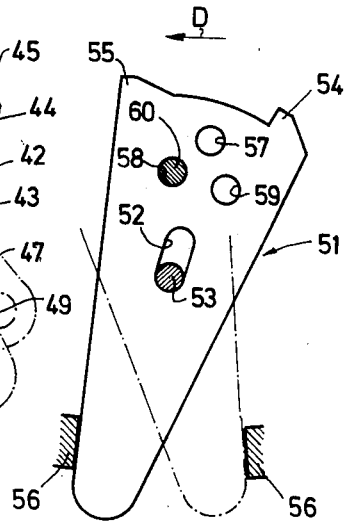

FIGS. 6–8 illustrate further examples of rotating selector elements which work in principle in the same manner as lever 17, and which also have different cam faces on one and the same adjusting member in order to displace the needles 9 into the desired working position.

FIG. 6 shows a rotary selector member 31 which is essentially constructed as a generally square plate with cam faces 32, 33 provided on each of two opposite sides thereof. This selector member 31 is rotatable about a rigid axis 34. Again several such rotary selector members 31 are stacked vertically on and for rotation about the common axis 34 in the device 13. A locking block 35 which is slidable in the direction of the double-headed arrow P presses all the selector members 31 when adjusted to their correct working positions, against a fixed end stop 36. In the adjusted position according to FIG. 6, cam 32 will co-act with butt 14 of pattern bar 3 in region B of the lock trick shown in FIG. 2, so that the needle can be displaced into the tucking position by means of cam 32. If the rotatable selector member 31 is turned anticlockwise through 90°, as shown in FIG. 6, the associated steering butt 14 of a pattern bar 3 will remain uninfluenced and the knitting needle will move into the knitting position. With the rotary selector member 31 turned anticlockwise through 180°, cam 33 will engage with a steering butt 14 in region A of the lock trick shown in FIG. 2, with the result that the knitting needle will remain in the floating position.

FIG. 7 shows an angularly movable selector member or slider 41 having an elongated hole 42 whereby it is angularly movable and slidable. Further members are stacked vertically about a common axis 43. A frontal lever arm 44 of the selector member 41 is provided with a single cam face 45 which can be adjusted between two working positions by corresponding angular movement of the member 41. The position shown on the left in FIG. 7 corresponds to the tucking position while the position shown on the right corresponds to the floating position of the knitting needles. If the member 41 is retracted as allowed by the elongated hole 42 which embraces axis 43, there is no operative engagement between the cam face 45 and a pattern-bar butt 14 so that the needles are driven fully out to the operative knitting position.

Each selector member 41 has a second lever arm 46 in which three bores or holes 47, 48, 49 are arranged in such a manner that in each and all positions of the selector members one of the bores or holes of each member is in line with a bore or hole of the other selector members. A locking pin 50 is then inserted into these mutually aligned holes thereby fixing the members 41 in the respectively selected working position.

FIG. 8 shows an angularly movable member 51 similar to member 41 in FIG. 7. The selector member 51 has an elongated hole 52 in which is a pin 53 whereby it is pivotable jointly with further selector members of this type about the pin. Whereas the selector member 41 shown in FIG. 7 only has a single cam with cam face 45, two cams 54, 55 are provided on the selector member 51. In the position represented in FIG. 8 cam 55 occupies the operative or effective position. This position corresponds to the tucking position of the knitting needles. If cam 54 is displaced into the other effective position (shown in dotted lines in FIG. 8) the knitting needle remains in the floating position. In order to allow the needle to move into the operative knitting position the selector member 51 must be pulled back or retracted relative to axis 53. In the two positions shown in FIG. 8 the rotary selector member 51 is locked or arrested in each case by one of two counter stops 56. The selector member 51 is further provided with holes 57, 58 and 59 arranged in the same manner as the bores 47, 48, 49 in selector member 41 and working in the same sense. By means of a locking pin 60 the selector member 51 can again be locked in its various working positions.

Figure 9:
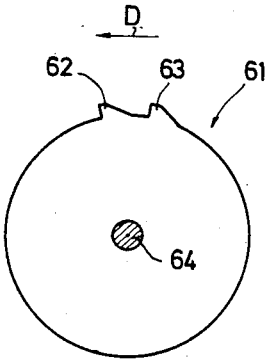
Figure 10:
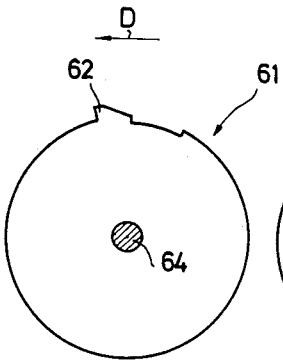
Figure 11:
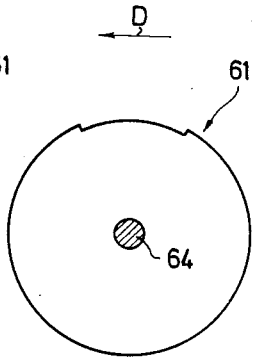

FIGS. 9–11 show another example of a rotary selector member 61. Each member is in the form of a disc which is rotatable through 360° and is provided on its periphery with cams 62, 63 adapted to co-act with the steering butts 14 of the pattern bars 3. The selector discs 61 are rotatable about a single common axis 64. The selector disc 61 is initially manufactured as shown in FIG. 9. In this form the selector disc 61 in the position represented in FIGS. 9–11 results in the floating position of the knitting needles. If cam 63 is removed (FIG. 10) the needles move into the tucking position. If, according to FIG. 11 both cams 62 and 63 are taken off the selector disc 61 the needles are fully driven out and achieve the operative knitting position.

The cam formations shown in FIGS. 9–11 may be repeated several times about the peripheral edge of the disc 61. The selector discs 61 are stacked vertically for rotation about a common axis to make up a selector drum unit which can be cyclically rotated during operation of the knitting machine thereby influencing the knitting needles in accordance with the desired three-way technique.

Figure 12:
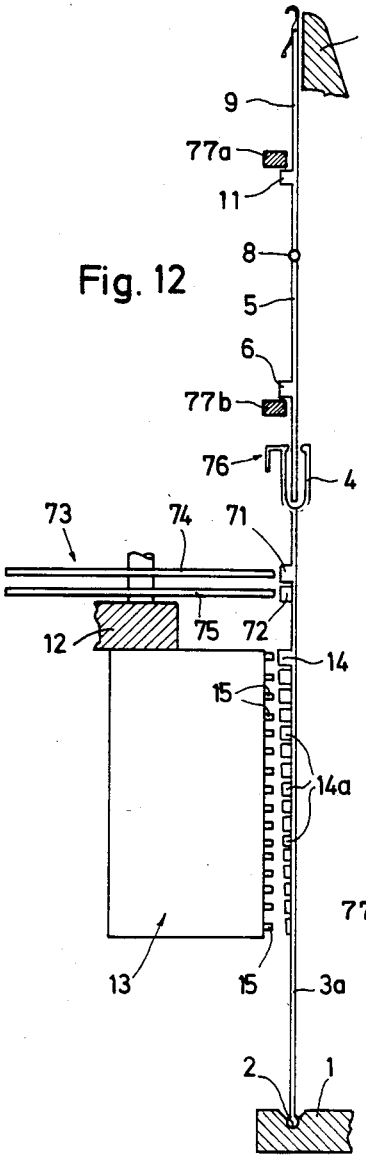
FIG. 12 is a similar view to FIG. 1 showing the additional provision of a pattern wheel or dial.
Figure 13:
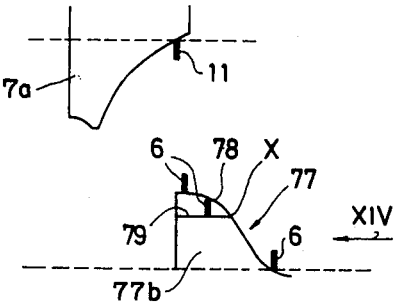
FIG. 13 shows lock grooves or tricks for the arrangement shown in FIG. 12.
Figure 14:
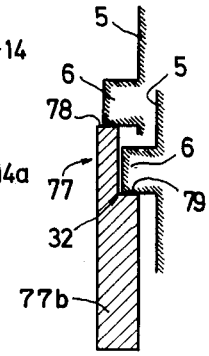
FIG. 14 is a schematic view in the direction of arrow D in FIG. 13.

FIGS. 12–14 relate to a modified embodiment of the invention. Corresponding parts in FIG. 12 carry the same references as in FIG. 1. The adjusting members in the selector device 13 may be rotary selectors of the above described type. Their protruding cam parts which co-act with the steering butts 14, 14*a* of the pattern bars 3*a* are generally indicated at 15 in FIG. 12. As shown, the pattern bars 3, each of which is provided with two further vertically spaced steering butts 71, 72, co-act with a pattern wheel or dial 73, which is known per se, and which is mounted on the fixed part 12 for rotation with the selector device 13. For fine machine calibration the pattern wheel 73 preferably consists of two superposed rotationally rigid pattern discs 74, 75 of which the upper disc 74 co-acts with steering butts 71 and the lower disc 75 with steering butts 72 in the sense that the pattern bar 3 can be influenced by the pattern wheel 73 to be selectively pivoted about the pivot 2 in the clockwise direction. To this end discs 75, 74 comprise relatively offset or staggered teeth which work as cams and which come into the trajectories of the steering butts 71, 72 and thereby cause pivotal movement of pattern bar 3, in a similar fashion to the action of the cam faces 15 at the ends of the selector members in the device 13.

The restoring of the pattern bars 3 which have been moved outwardly by pattern wheel 73 or by selector device 13 is performed in conventional manner by means of a lock part (not shown), which engages with a U-shaped sinker extension 76 of the head 4. This equally applies to the arrangement of FIG. 1.

In the embodiment of the invention which includes the pattern selector wheel 73, the track 77 in lock part 77*b* has the special configuration as shown in FIGS. 13 and 14. Starting from a point X the track is divided into two laterally adjacent steps 78, 79, which save space and on which the butts 6 of swivel bar 5 slide up selectively thereby bringing the needles selectively into the knitting or tucking position. The selection is made by means of the pattern wheel 73. Depending on whether or not the pattern bar 3 and with it the associated swivel bar 5 has been subjected to an additional swivel movement by one of the teeth or cams of pattern selector wheel 73, the butt 6 of swivel bar 5 will arrive either on step 79 or on step 78 of the lock track, that is to say either in the tucking or in the knitting position. If in the absence of actuation by pattern selector wheel 73 the butt 6 is not subjected to any swivel movement it will follow the upper trajectory shown in FIG. 14; when pivoted by swivel bar 5, following actuation of the latter by pattern wheel 73, butt 6 will follow the lower trajectory shown in FIG. 14.

In an arrangement of the kind shown in FIGS. 12–14 the sliders of the selector device 13 need occupy only two operative or effective positions, one of which is initiated on expulsion of the knitting needle 9 whilst in the other effective position the needle remains in the floating position. If while the knitting needle 9 is expelled or driven outwards, the pattern bar 3 and with it the swivel bar 5 are further displaced due to engagement of a cam on pattern selector wheel 73 with one of the butts 71, 72, butt 6 of swivel bar 5 arrives on step 79 of the lock trick 77 so that the knitting needle is stopped in the tucking position. In other words, in an arrangement according to FIGS. 12–14 the actual selection of the tucking and the knitting position is made by the pattern selector wheel 73 whereas the selector device 13 simply decides between needle movement or no movement. The sliders in the selector device 13 of FIG. 12 may therefore be correspondingly more simply designed than the rotating cam element shown in FIGS. 3–11 because they are required only to be capable of occupying two effective positions. The selector device 13 may also be constructed as a conventional pattern drum, pattern roll or as a stacked pattern-disc assembly.

FIG. 13 further shows the butt 11 on the knitting needle 9 as well as the upper lock part 77*a* co-acting therewith which imparts the retraction movement to needle 9.

Figure 15:
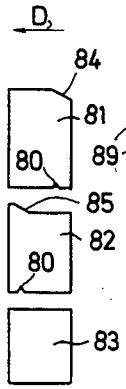
FIGS. 15 and 16 illustrate further embodiments of sliders according to the invention.

FIG. 15 shows a further example of the invention with sliders which however in this case are not rotary sliders but simple sliders arranged selectively in a single row in vertically stacked formation for each yarn feed station of the knitting machine. There are three selectively applicable sliders 81, 82, 83 which are mounted in the selector device 13 in a manner known per se. Slider 81 has a terminal cam face 84 which at the correct point in time engages the butt 14 of a pattern bar 3 thereby holding the knitting needle fast in the floating position. Another cam face 85 arranged at a different point of the slider 82 takes care of transferring the knitting needle into the tucking position. Lastly, slider 83 has no cam face and therefore allows unimpeded needle movement into the knitting position. The parts 81, 82 and 83, hereinbefore called the "sliders" are in fact non-slidable parts which are selectively inserted in the selector device 13 and there immovably fixed. A notch 80 on the backside of sliders 81, 82, identifies their respective function.

Figure 16:
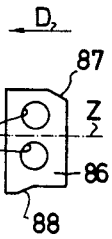

FIG. 16 lastly shows another kind of rotary slider or shifting member 86 with cam faces 87 and 88. The rotation axis is indicated by the dot-and-dash line Z. Depending on whether the knitting needles are to be displaced into the floating, tucking or knitting position, the member 86 is inserted and immobilised in selector device 13 in such a manner that either cam face 87 or cam face 88 can engage with the steering butt 14 of a pattern bar 3. Prior to a transfer from one to the other of these positions the member 86 must be taken out of device 13 and turned about the rotation axis Z. If the knitting needle is to move into the knitting position a simple cam-free spacer piece will be fitted in selector device 13 instead of member 86 for the affected pattern bar 3.

The rotary shifting member 86 has two holes 89 in which selectively—depending on the selected arrangement—a locking pin similar to pins 50 and 60 in FIGS. 7 and 8 is inserted to prevent movement of the member 86.

We claim:

1. A needle selector device for use in a multi yarn feed knitting machine operating by the three-position method, with vertically stacked angularly movable sliders, and having pattern bars mounting steering butts, swivel bars engaging the pattern bars and in their turn articulately connected to the knitting needles, the sliders co-acting with the steering butts of the pattern bars and thereby determining the movement of the knitting needles into their floating, tucking or knitting position, characterized in that for each yarn feed station in the knitting machine there is provided a single row of said vertically stacked angularly movable sliders, said sliders being formed identically to one another and being movable about a common axis and being adapted to be selectively adjusted and immobilised in one of three operative positions thereof, the first operative position corresponding to the floating position, the second operative position corresponding to the tucking position and the third operative position corresponding to the knitting position.

2. A device according to claim 1, characterised in that each slider defines two cams arranged along its circumferential edge, either one of which can selectively engage with the steering butts of the pattern bars.

3. A device according to claim 1 or claim 2, characterised in that the sliders are constructed in the form of selector levers which are pivotable about the common axis, the levers having a first lever arm co-operable with the steering butts of the pattern bars and a second lever arm adapted to be applied by means of a common locking block selectively to end stops corresponding to the different operative positions.

4. A device according to claim 3, characterised in that the locking block includes a recess for locking engagement therein of the second lever arm.

5. A device according to claim 1 or claim 2, characterised in that the slider is provided with an elongated slot whereby the slider can be moved angularly and also displaced axially relative to the common axis.

6. A device according to claim 5, characterised in that the sliders comprise holes adapted to receive a common locking pin.

* * * * *

UNITED STATES PATENT AND TRADEMARK OFFICE

CERTIFICATE OF CORRECTION

PATENT NO. : 4,541,254

DATED : September 17, 1985

INVENTOR(S) : Alfred Schindele and Herbert Lotze

It is certified that error appears in the above-identified patent and that said Letters Patent is hereby corrected as shown below:

Column 1, line 48, "trick" should read --track--;
line 55, "tricks" should read --tracks--.
Column 2, line 24, "tricks" should read --tracks--.
Column 4, line 6, "trick" should read --track--;
line 18, "trick" should read --track--;
line 64, "trick" should read --track--.
Column 5, line 5, "trick" should read --track--.

Signed and Sealed this

*Twenty-fifth* Day of *March 1986*

[SEAL]

*Attest:*

DONALD J. QUIGG

*Attesting Officer*

*Commissioner of Patents and Trademarks*